United States Patent [19]

Martel

[11] Patent Number: 4,662,333

[45] Date of Patent: May 5, 1987

[54] CARBURETOR WITH AUTOMATIC STARTING DEVICE

[75] Inventor: Bernard Martel, Chatou, France

[73] Assignee: Solex, Nanterre, France

[21] Appl. No.: 762,278

[22] Filed: Aug. 5, 1985

[30] Foreign Application Priority Data

Aug. 3, 1984 [FR] France ..... 84 12350

[51] Int. Cl.[4] ..... F02D 41/06; F02D 41/16; F02M 1/12

[52] U.S. Cl. ..... 123/339; 123/179 G; 123/438; 261/39.4; 261/39.6

[58] Field of Search ..... 123/437, 438, 179 G, 123/339; 261/39 A, 39 C, 39 E

[56] References Cited

U.S. PATENT DOCUMENTS

| | | | |
|---|---|---|---|
| 4,352,347 | 10/1982 | Osano et al. | 123/179 G X |
| 4,391,249 | 7/1983 | Bianchi et al. | 123/438 |
| 4,463,723 | 8/1984 | Tansuwan | 123/438 |
| 4,498,440 | 2/1985 | Nomura et al. | 123/438 |
| 4,524,742 | 6/1985 | Bonfiglioli et al. | 123/339 X |
| 4,527,527 | 7/1985 | Irino et al. | 123/438 |

FOREIGN PATENT DOCUMENTS

| | | | |
|---|---|---|---|
| 1517783 | 7/1978 | United Kingdom | 123/179 G |

*Primary Examiner*—Tony M. Argenbright
*Attorney, Agent, or Firm*—Larson and Taylor

[57] ABSTRACT

A carburetor is provided with an automatic starting device, more especially for motor car engines, comprising a butterfly valve controlled by the driver and -for starting up and cold running of the engine- an automatic starting device. This device comprises a start air valve (choke) and a wax capsule which controls the position of the air valve and the minimum opening position of the butterfly valve. The wax capsule is provided with a heating resistor and a temperature sensor. The starting device further comprises a computer having inputs connected to the temperature sensor and to sensors supplyng signals representative of the operating conditions of the engine. It controls the electric power applied to the heating resistor. The computer imposes on the butterfly valve and on the air valve a degree of opening which depends, on the one hand, on the temperature sensitive element during start up of the engine and, on the other hand, on the number of revolutions effected by this latter from start up.

9 Claims, 6 Drawing Figures

CARBURETOR WITH AUTOMATIC STARTING DEVICE

FIELD OF THE INVENTION

The invention relates to carburetors for internal combustion engines of the type comprising, for normal running of the engine, a main fuel jet system which opens into the intake duct upstream of a throttle member (or butterfly valve) controlled by the driver and—for starting up and cold running of the engine—an automatic starting device which comprises a starting air valve situated in the intake duct upstream of the outlet of the main fuel jet system and a temperature responsive power element in which a material contained in a closed enclosure undergoes a variation of volume responsive to temperature, which controls the position of the starting air valve and the minimum opening position of the throttle valve.

PRIOR ART

French Patent Application No. 2,257,790 describes a device of the above-defined type in which the temperature sensitive element, which is frequently called a "wax capsule", is subjected to the temperature of the cooling water of the engine. With a wax capsule, much greater forces can be exerted than with the bimetal spirals generally used in starting devices. Consequently, it allows elements subjected to friction or to the action of return springs to be moved and the previous setting required in bi-metal spiral systems to be suppressed.

One of the problems arising with cold start devices is that they must impose on the butterfly valve a minimum degree of opening sufficient to allow start up even at low temperatures and then must reduce this minimum opening so as to prevent racing of the engine. Experience has shown that devices using the temperature of the cooling water as control parameter do not allow idling of the engine to be maintained at a speed close to its nominal speed during the first ten seconds or so following the cold start. The friction forces which brake the engine in fact decrease very rapidly after start up and the temperature of the wall of the combustion chambers increases much more rapidly than that of the cooling water. Temporary operation at an idling speed very much greater than the set speed results more especially in a rise in fuel consumption and an increase in pollution.

A starting device is know using a wax capsule, described in French Pat. No. 2,288,224, which brings to the problem a partial solution by using a wax capsule which is not subjected to the temperature of the cooling water but which is provided with rapid electric heating means which may be formed by a positive temperature coefficient or PTC resistor. The purpose of the wax capsule however is only to obtain forced opening of the starting valve or "choke" and consequently only very partially overcomes the different problems arising during start up and cold running of the engine. In particular, it does not allow the running speed to be decreased by closing the butterfly valve.

OBJECT OF THE INVENTON

It is an object of the invention to provide a carburetor of the above-defined type having a starting device which allows the different situations which may be met with during start up and cold running to be taken into account until the engine has reached its normal operating temperature. These situations may be more especially the following:

- idling: engine uncoupled (gearbox in neutral and/or clutch pedal pressed) and unloaded (accelerator pedal at rest);
- deceleration: engine unloaded and coupled;
- off load running: engine uncoupled with open throttle;
- normal running: engine loaded and coupled.

SUMMARY OF THE INVENTION

To solve this problem, the invention provides a carburetor of the above-defined type whose temperature sensitive element is provided with a heating resistor and a temperature sensor, the starting device further comprising computer means having inputs connected to the temperature sensor and to sensors supplying signals representative of operating conditions of the engine and an output connected to control electric power applied to the heating resistor, computer means being arranged for imposing on the butterfly valve and on the air valve in opening which depends on the temperature of the temperature sensitive element during start up of the engine and on the number of revolutions effected by the latter from start up.

According to another aspect of the invention, the carburetor comprise an idling circuit having a primary air supply, a fuel supply and an output for delivering a primary mixture having a high fuel/air ratio into the intake duct, equipped with a manual adjustment element (such as a screw) adjustable so as to give to the engine a fuel/air ratio during idling less than that which would be required in the absence of regulation and the idling circuit is provided with a solenoid valve controlled by computer means in response to a reduction in speed of the engine below a predetermined threshold for increasing the richness (fuel/air ratio) of the mixture supplied to the engine and avoiding stalling. By thus acting on the richness of the mixture, a rapid response system is obtained and the idling circuit can be adjusted so that the mixture supplied to the engine when this latter is idling is lean, which is an antipollution factor. This antistalling function by temporarily increasing the richness is most advantageous when associated with speed regulation by the computer means, the latter adjusting the heating power applied to the temperature sensitive element.

As a general rule, full opening of the air valve will be reached for a temperature of the temperature sensitive element very much less than the temperature above which that element brings the throttle valve to the minimum opening position thereof. According to yet another aspect of the invention the throttle valve is not associated with a conventional mechanical stop element defining an adjustable position which cannot be exceeded toward closure. Regulation of the idling speed when the engine runs at its normal temperature will therefore take place by very low amplitude oscillations of the throttle valve during idling, this regulation having a much higher time constant than that of the system for preventing stalling (the latter time constant being much less than 1 s).

Such as defined above, the starting device executes a "program" well adapted to start up of an engine which has been at rest for several hours and whose temperature is stabilized. On the other hand, the temperature sensor alone does not detect the thermal state of an engine which operated for a certain time shortly before start up but did not reach its normal operating temperature.

For example, after the hood of a stopped engine has remained open for a few minutes, the temperature sensitive element may cool down to the extent that it causes closure of the starting valve, although the engine is still warm: cranking the engine under these conditions may flood the engine due to an excess of richness.

In a particular embodiment of the invention, the speed of the engine driven by the starter motor, before the engine becomes self-operative, is used as a parameter for selecting the program determining the fuel/air ratio to be supplied to the engine, depending on its thermal condition.

The speed of the engine driven by the starter motor varies greatly depending on the thermal state of the engine: for example, a cold engine which did not run since several hours will have a low speed, generally of about 60 to 150 rpm due to the high viscosity of the lubricating oil or to a low voltage of the electric battery, whereas an engine which has just been running, even if it is far from its normal operating temperature, will have a very much higher speed when driven by the starter motor, of about 180 to 250 rpm.

The temperature sensitive element may for example be heated at start up, when the speed of the engine driven by the starter motor is at least equal to 150 rpm, so as to rapidly open the starting valve and thus avoid excessive enrichment of the fuel/air mixture supplied to the engine. Heating is cut off at the speed from which the engine becomes self operative typically at about 350 rpm.

The invention will be better understood from reading the following description of a particular embodiment given by way of example.

SHORT DESCRIPTION OF THE DRAWINGS

DETAILED DESCRIPTION OF A PARTICULAR EMBODIMENT

Figure 1:
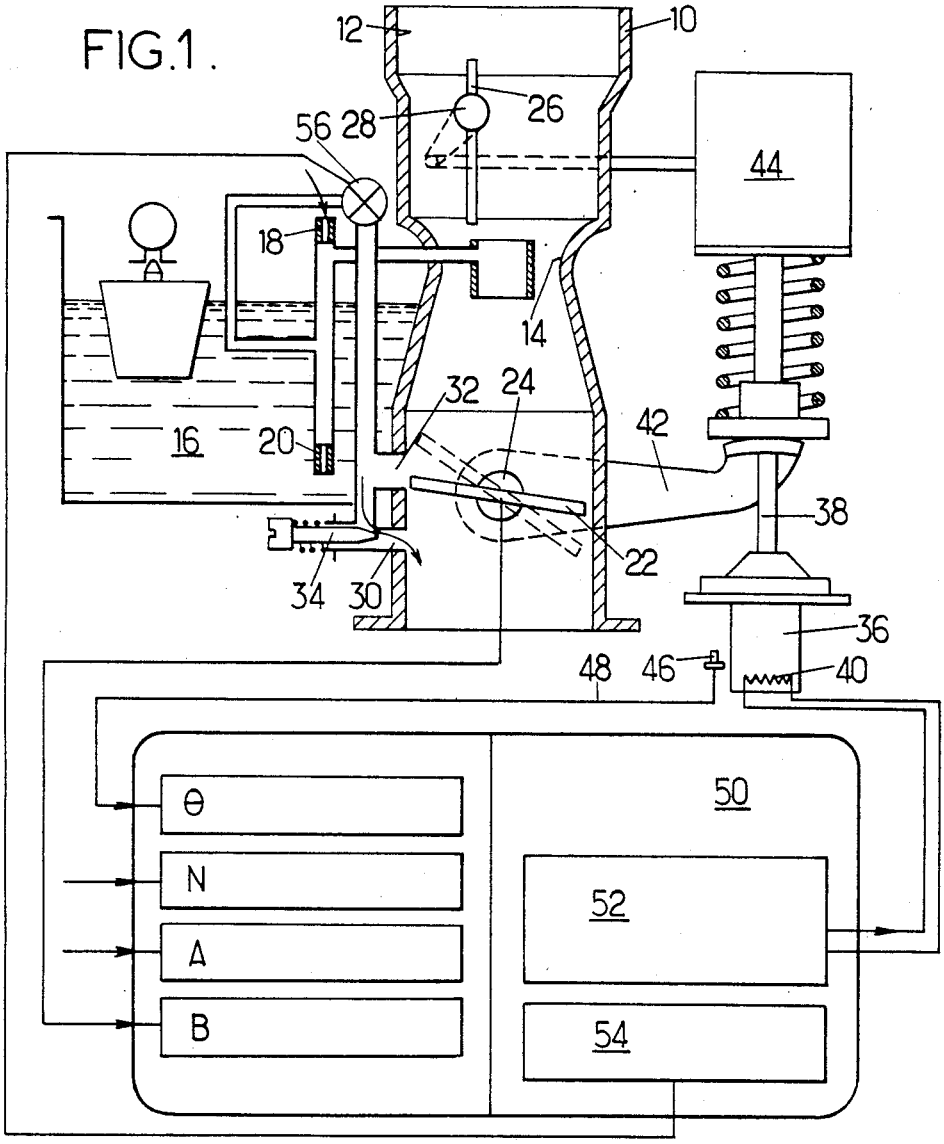
FIG. 1 is a general diagram showing the functional connections between the carburetor and the components of the starting device.

Referring to FIG. 1, a carburetor comprises a body 10 made from several assembled parts in which is provided an intake duct or induction passage 12. A main fuel jet system, opening at the throat of a venturi 40 of the intake duct 12, is fed with rich primary fuel/air mixture obtained from a float chamber 16 and from the atmosphere. Calibrated restrictions 18 and 20 are placed in the air and fuel paths to the jet systems. A throttle member (butterfly valve) 22 is placed downstream of venturi 14 and fixed on a rotary shaft 24 controlled by the driver through a linkage (not shown). A return spring (not shown) biases the butterfly valve toward closure. Upstream of the venturi 14 is placed an air valve or chocke 26 mounted on an off-centered shaft 28 so that the flow of air sucked by the engine tends to move it to the full open position in which it is shown.

The carburetor further comprises an idling circuit receiving a rich primary fuel/air mixture from the main jet system. The idling circuit opens into the intake duct 12 through an idling port 30 placed downstream of the butterfly valve 22 and a bypass slit 32 located for passing progressively from upstream to downstream of the butterfly valve as the latter opens. A manual adjustment screw 34 allows adjustment of the flow rate passing through orifice 30 and of the richness of the mixture supplied to the engine during idling, when the edge of the butterfly valve is downstream a slit 32.

The carburetor comprises a device which is particularly effective during start up and cold running of the engine for adjusting the positions of flap 26 and of the butterfly valve 22. This device comprises a temperature sensitive power element 36 which will be designated hereafter by the term "wax capsule". This element is formed by a closed enclosure occupied by a thermo-expandible material which expands upon temperature increase and imparts to a rod 38 in contact therewith an amount of projection which increases with the temperature of the element. The temperature is controlled by modulating the electric power applied to a heating resistor 40 in thermal contact with the enclosure.

Rod 38 is coupled to an arm 42 having an abutting connection with pin 24. The abutting connection determines a minimum opening position of the butterfly valve depending on the position of rod 38 and beyond which the butterfly valve may be opened by the driver. A mechanical linkage 44, an embodiment of which will be described later, is provided between wax capsule 36 and air valve 26 for controlling the position of air valve 26 as long as it is not in its fully open position, reached for a predetermined temperature of the wax capsule 36. That predetermined temperature is less than the temperature during operation of the engine under normal running conditions.

A temperature sensor 46, which may be a negative temperature coefficient resistor or NTC, is associated with the wax capsule 36 so as to supply an electric signal depending on the temperature of the latter.

Sensor 46 is connected by a conductor 48 to one of the inputs of computer means 50 which may comprise a microprocessor, a ROM storing a map representation and whose function will be explained further on and a working RAM. An analog-digital converter will then be provided for transforming the analog signal from sensor 46 into a digital signal.

Other inputs of the computer means 50 are connected respectively to a sensor supplying a signal depending on the speed N of the engine, to a sensor assembly placed on the gearbox and the clutch for supplying a binary signal A indicating whether the engine is coupled to the box or not and to a sensor supplying a binary signal B indicating whether the butterfly valve 22 is close to its minimum opening position or not. The speed sensor may consist of a probe providing a pulse for each rotation of the ignition breaker.

A first output of the computer means 50 comprises an actuator 52 supplying to the heating resistor 40 the electric power required for maintaining it at a reference temperature $\theta c$ determined in accordance with a law which will be described further on. A second output 54 controls opening and closing of a solenoid valve 56 placed in the idling circuit of the carburetor, upstream of slit 32. The computer means 50 is arranged for supplying, on output 54, a pulse width modulation signal having a variable duty cycle, for adjusting the richness of the mixture supplied to the engine on idling.

Figure 2:
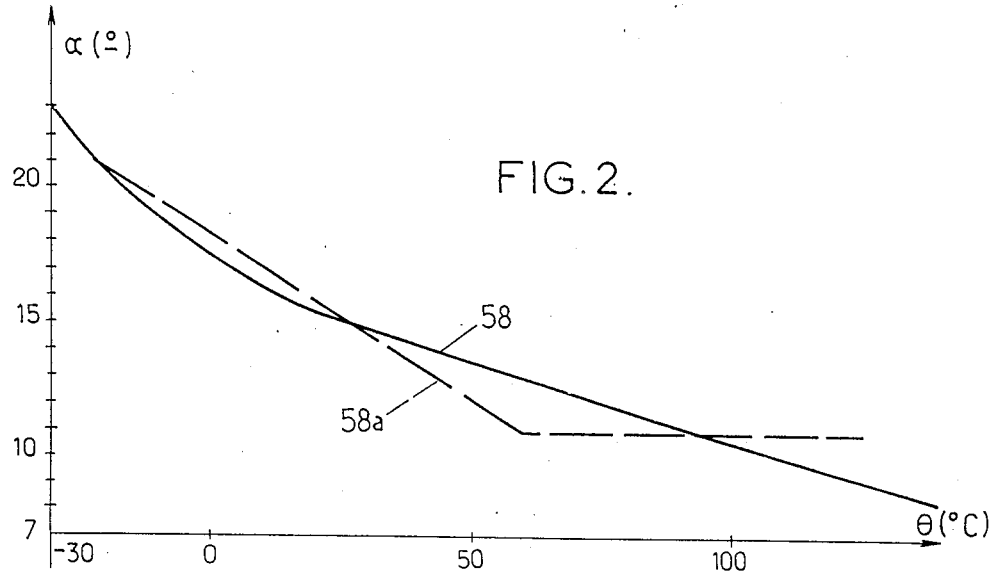
FIGS. 2 and 3 are curves representative of the idling speed N imposed on the engine as a function of the number of revolutions M effected by the engine since start up and of the initial temperature ($\theta_0$) of the wax capsule.
Figure 3:
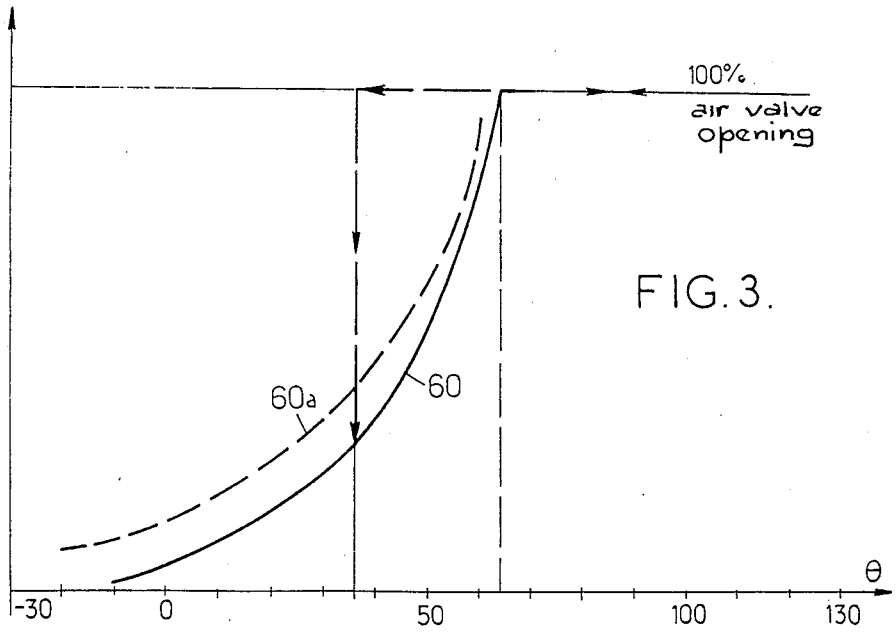

The assembly formed by capsule 36, arm 42 and linkage 40 will be designed so as to give to butterfly valve 22 and to air valve 26 degrees of opening responsive to the temperature of the capsule according to a law as shown by continuous lines in FIGS. 2 and 3, respectively. Referring to FIG. 2, the minimum degree of opening $\alpha$ of the butterfly valve 22 as a function of the temperature, shown by curve 58, varies in response to temperature to exhibit a steady decrease from the minimum temperature at which the engine must be able to start up (−30° C. in the example illustrated) up to the maximum temperature which the wax capsule 36 may assume. On the other hand, the prior art devices using a wax capsule were generally designed so that the minimum opening position of the butterfly valve imposed by the starting device reaches a minimum value for a predetermined temperature of the capsule and then retains it if the temperature is further decreased. That minimum value was fixed by abutment of the butterfly valve against a mechanical, generally adjustable, stop. The shape of the corresponding curve is shown by the broken line curve 58*a*.

Such a mechanical stop will as a general rule be omitted in a carburetor according to the invention, which allows self adjustment of the idling speed by the temperature of the wax capsule 36. With such regulation, it is possible to adopt a set value Nc of the idling speed of the engine operating under normal temperature conditions which is appreciably lower than in carburetors with manual idling adjustment. The idling speed Nc will be maintained whatever the load applied to the engine, for example if the load is increased upon energization of an accessory, for example an air conditioning apparatus.

Moreover, the mixture normally supplied for idling may be manually adjusted "lean" with screw 34 for a set duty cycle of the signal applied to the solenoid valve 56, corresponding to normal operation. The duty cycle will be temporarily modified by the computer means 50 for increasing the richness should the running speed of the engine drop below Nc, with a short time constant, until the computer means, operating in a closed regulation loop, has brought the engine back to its set idling speed by changing the temperature of the wax capsule 36. The latter regulation, with a much longer time constant, is accompanied by a return to the set value of the duty cycle of the signal controlling the solenoid valve 56.

In a modified embodiment, a solenoid valve 56 which is closed at rest, is placed in parallel flow relation with a calibrated passage supplying the amount of fuel/air mixture required for normal idling.

Referring to FIG. 3, the law of control of opening of the air valve 26 may be as shown by a continuous line 60. That law 60 is comparable to the law 60*a* of a prior art carburetor with a wax capsule. It should be noted however that the air valve reaches its fully opened position at a temperature of the wax capsule 36 very much less than the maximum temperature to which it may be brought during operation, for example about 65° C. as illustrated in FIG. 3.

The computer means 50 will be programmed for control of the air valve 26 and the butterfly valve 22 during start up using as essential input parameter the temperature $\theta_0$ of the wax capsule at the time of cranking the engine (i.e. the ambient temperature in the case of a cold start) and the number of revolutions M effected by the engine from cranking (the latter parameter being possibly replaced with the time t elapsed from the beginning of cranking).

Temperature regulation is for:

giving at all times to the wax capsule 36 a temperature such that the speed N of the engine assumes a set value Nc depending on $\theta_0$ and M, when the engine is idling, giving to the temperature a value depending on $\theta_0$ and M in all other cases.

Figure 5:
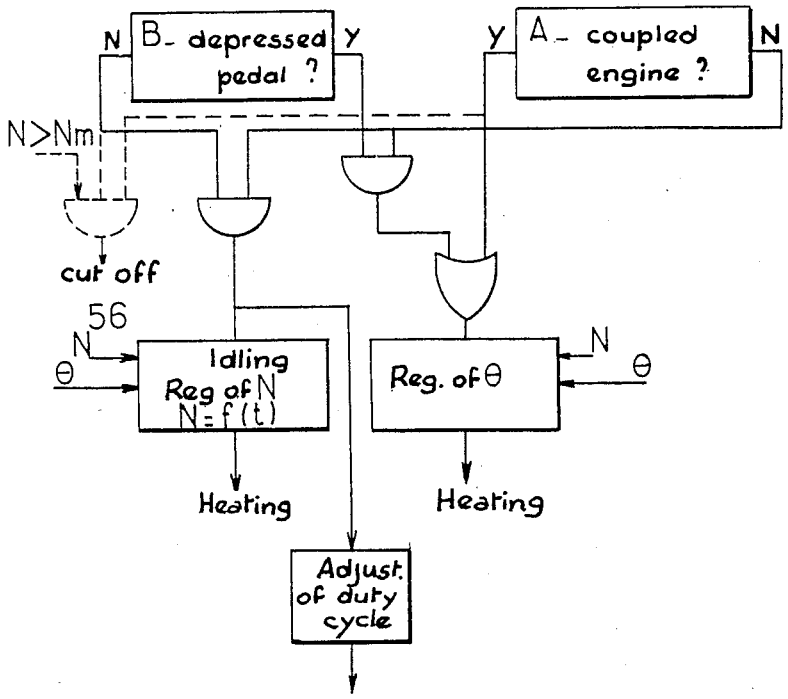
FIG. 5 is a flow chart showing the functions of the computer means.

Selection between the two programs may be achieved either by software or by hardware, the functions to be fulfilled being in both cases as shown schematically by the flow sheet of FIG. 5.

Regulation of idling speed to a set value Nc

Speed regulation is by on/off control of the heating power applied to resistor 40: if $N > Nc$, heating power is applied to the wax capsule 36. If $N \leqq Nc$, no heating is applied. The set value Nc to be given to the engine will be stored in a ROM of the computer means 50 as a table causing particular values Nc to correspond each to a pair of value ranges of $\theta_0$ and M (or t). That part of the table which corresponds to the time period immediately following start up of the engine may for example be as follows:

| Nc(rpm) | $\theta_0$(°C.) | Zone |
|---|---|---|
| 1250 | −10 to 0 | 1 |
| 1150 | 0 to 10 | 2 |
| 1050 | 10 to 15 | 3 |
| 1000 | 15 to 20 | 4 |
| 950 | 20 to 30 | 5 |
| 900 | 30 to 40 | 6 |
| 800 | 40 to 50 | 7 |
| 660 | >50 | 8 |

Beyond the initial start up phase, the computer means progressively reduces the set speed Nc from its initial value. For example, there may be a reduction of the set idling speed whenever the computer means 50 has received 2500 additional pulses each indicating an ignition of the engine.

Figure 4:
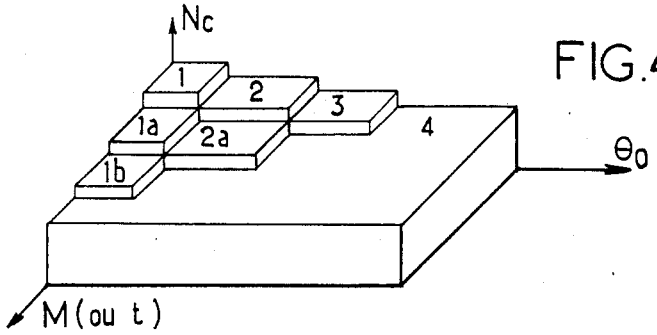
FIG. 4 is a map representation of the idling speed N imposed on the engine as a function of the number of revolutions M effected by the engine since start up and of the initial temperature ($\theta_0$) of the wax capsule.

The progression of the set idling speed Nc may then be as shown in FIG. 4, where only four reference speeds (instead of eight) have been shown for simplicity. It will be appreciated that when starting up at a very low temperature, the operation corresponds to zone 1, then it progresses through zones 1*a*, 1*b* and finally arrives in zone 4 which corresponds to idling regulation under normal running conditions.

Temperature under normal running conditions

Outside idling, the computer means 50 regulates the temperature of capsule 36 to a set value $\theta c$ which also depends on the starting temperature, with a progression of the reference temperature by steps, each step corresponding to a predetermined number of revolutions of the engine. For example, it is possible to provide eight reference values $\theta c$ immediately after start up, ranging for example from 5° C. to 70° C. for ranges of value $\theta_0$ beginning at −30° C. up to 40° C. There is progression, as in the case illustrated in FIG. 4, in so far as the running speed is concerned, whenever the engine has operated through an additional predetermined number of revolutions (for example after 2500 ignitions). If the temperature of the wax capsule 36 is then less than the reference temperature, the computer means 50 causes the application of a heating "pulse", for example of 5 ms, representing a given amount of heat, by means of actuator 52 at each revolution of the engine. There is no heating if $\theta > \theta c$.

It is important to note that there is simultaneous evolution of the set values of the running speed Nc and temperature $\theta c$, although a single reference is actually used at each time.

Cut off during deceleration (engine driven by the car)

The solenoid valve 56 may also be controlled for fuel cut off during deceleration with partial or complete resumption, programmed or not, when the speed N of the engine exceeds one or more thresholds.

The computer means 50 may also achieve fuel cut off during deceleration by permanently energizing the electromagnetic valve 56 (duty ratio of 100%) when at the same time the engine is coupled to the gear box, the accelerator is not depressed and the speed N is greater than a threshold Nm. The corresponding flow chart is shown with broken lines in FIG. 5.

Cut off of fuel upon ignition opening

Similarly, the computer means may suppress self-ignition upon opening of the ignition switch by temporarily cutting off the flow of primary mixture to the idling circuit. It is known that the solenoid valve 56 is advantageously open at rest so that—should the electric supply of the actuator fail—the driver is not hindered by considerable operating short comings. The usuel drawback of such an arrangement, namely the risk of self ignition upon opening of the electric ignition switch, is removed by incorporating a time delay in the computer means so that it maintains the solenoid valve fully closed for several seconds after cut off.

Deflooding

The computer means may be adapted for deflooding in the case of an abortive start up attempt. To avoid renewed failure to start up due to an excessive richness, the starting air valve should be opened after an abortive attempt at starting. This result may be obtained by programming the computer means 50 for electrically heating the wax capsule 36 when the following three conditions are simultaneously present:

- butterfly valve contact supplying a signal B indicating it is open,
- speed of the engine between 0 and 350 rpm (indicating that the engine is driven by the starter motor),
- operation in one of the zones 1 to 6 as defined in the above table, in which zones the air valve is normally closed (or partially closed).

Figure 6:
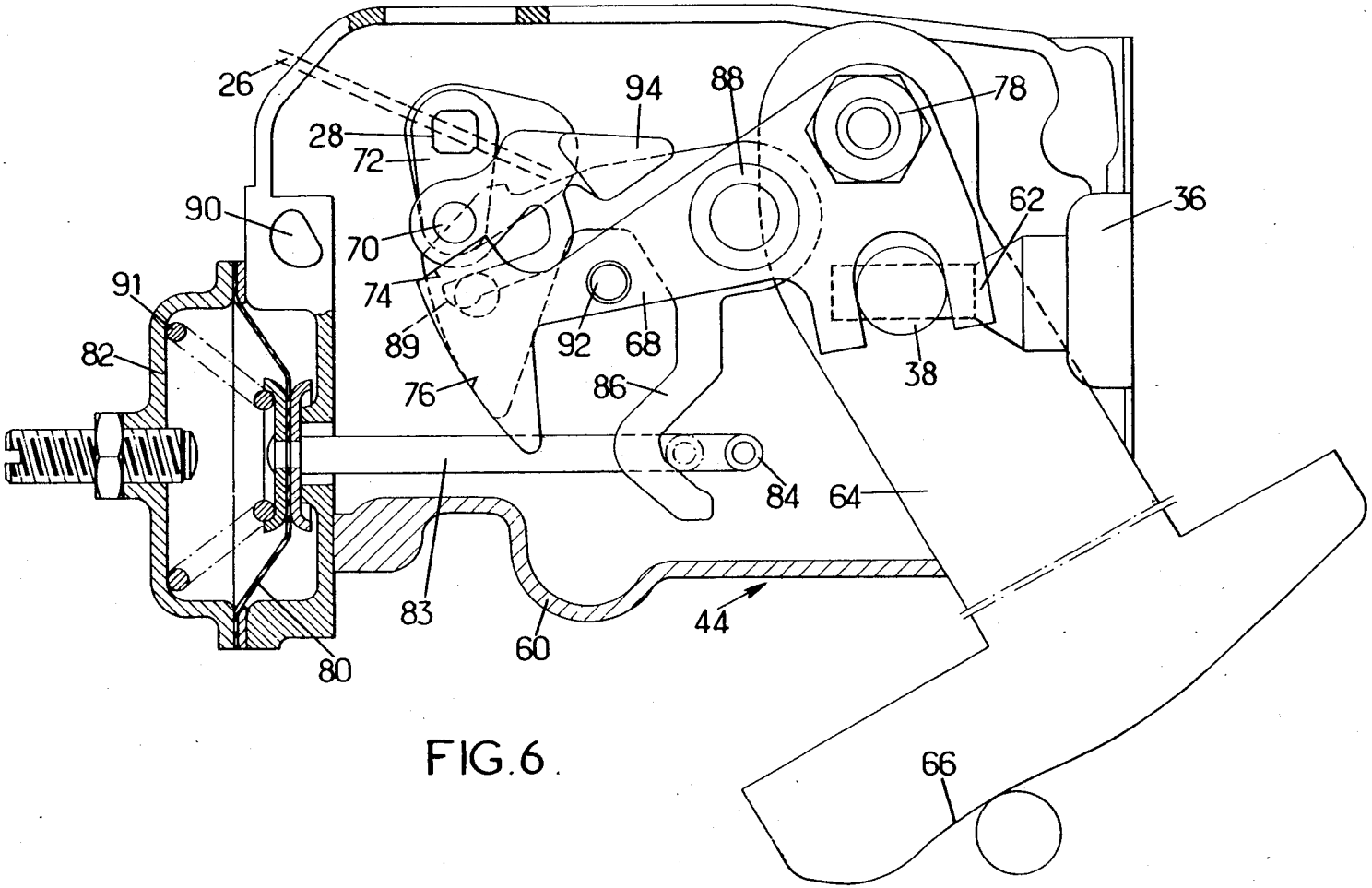
FIG. 6 shows a possible construction of the mechanical parts of the starting device, coupling the temperature sensitive element to the air valve and to the butterfly valve.

The mechanical linkage 44 may have different constructions. It will preferably be as shown in FIG. 6 in which the return springs have not been illustrated for simplicity.

Such return springs for biasing the butterfly valve and the air valve 26 towards their closed position may be as described in French Pat. No. 2,257,790.

The greater part of the linkage is in a casing 60 fixed to the body 10 of the carburetor by appropriate means (not shown) such as screws. The enclosure of the wax capsule 36 is fixed to the wall of casing 60 and its rod, 38 projects inside. The rod has a pin received in a fork of a crank lever 62 having a lower arm 64 ending with a cam 66 forming a stop for finger 42 (not shown in FIG. 6) fast with pin 24 of the butterfly valve 22. A second arm 26 also ends in a cam arranged for abutment with a pin 70 fast with a plate 72 fixed to the shaft 28 of the air valve and forming a lever. The cam has two consecutive surfaces. One of the surfaces 74 is for moving air valve 26 in the opening direction by bearing on pin 70. The other, 76, is formed by a circular edge centered on the shaft 78 of the crank lever and intended to hold the flap in its fully open position when the temperature of the capsule 36 is greater than a predetermined value (65° C. as illustrated in FIG. 3).

The starting device further comprises means responsive to the depression which prevails downstream of the butterfly valve 22 for "cranking open" the air valve as soon as the engine operates. These means comprise a diaphragm 80 placed in a casing 82 and subjected, on one face, to the pressure in the intake duct 12 downstream of the butterfly valve (communicated by a passage not shown) and the other to the atmospheric pressure. Diaphragm 80 is connected to a rod 83 whose curved end 84 has a unidirectional connection with one of the ends of a lever 86 pivotably mounted on a shaft 88 carried by lever 62. The other end of lever 86 forms, for pin 70 of the control lever 72, a stop which ensures a minimum opening of air valve 26 when a depression is established downstream of the butterfly valve 22. A return spring 91 acting against the pressure forces exerted on diaphragm 80 tends to bring rod 82 back to the rest position illustrated in FIG. 1 with a continuous line.

It is not necessary to describe here the role and operation of the means responsive to depression since they are conventional in nature.

The linkage 44 shown in FIG. 6 is arranged to present a hysteresis which facilitates restarting of the "hot" engine during the first ten minutes or so following stopping by taking into account the fact that the thermal inertia of the engine is much greater than that of the carburetor and that, in addition, the normal temperature of the cooling water of the engine (80° to 100° C.) is very much greater than that of the carburetor (20° to 40° C.). After stopping of the engine, the wax capsule 36 cools down rapidly while the engine remains at a higher temperature and it causes progressive closing of the air valve. But such closing is useless and often even harmful, if the engine is started up again after a few minutes or even a few tens of minutes. In fact, the engine is sufficiently warm to need no increase in the fuel/air ratio. The linkage of FIG. 6 comprises means for maintaining the air valve in the fully open position, during cooling until the temperature is below a value lower than that which corresponds to a complete opening during temperature increase. Referring to FIG. 3, that hysteresis corresponds to the curve shown with a broken line, indicating that full opening is retained up to about 35° C.; below that value, there is return to the normal curve of variation of opening in response to temperature.

Referring to FIG. 6, the result is obtained by providing lever 28 with a resilient finger 89 which hooks onto a projecting catch 90 provided on case 60 when the flap has reached its fully open position. During cooling, hooking is maintained until there is forced unlocking by abutment of a control stud 92 carried by lever 62 on a boss 94 of lever 72.

The device may be completed by means (bistable flip-flop whose inputs are connected to two comparators with respective thresholds of 150 rpm and 350 rpm for example) which cause in all cases heating as soon as as the engine is started up if the speed of the engine driven by the starter motor exceeds 150 rpm.

The invention is not limited to the particular embodiment which has been shown and described by way of example and moreover the computer means may fulfil functions in addition to those described or replacing some of them.

I claim:

1. A carburetor for an internal combustion engine, comprising:

(a) a body defining an intake duct, containing an operator operable throttle member, (b) a main fuel jet system which opens into said intake duct through an outlet located upstream of said throttle member, (c) an automatic starting device having an air valve located in said intake duct upstream of said outlet, said starting device including a temperature responsive power element operatively associated with said starting air valve for control of the degree of opening thereof and with abutment means limiting the extent of closure of said throttle valve, heating resistor means associated with said power element for controlling the temperature thereof and with a power source, temperature sensor means for providing a first signal representative of the temperature of said power element, sensor means for providing second signals representative of engine operating conditions, computer means having inputs connected to receive said first and second signals and an output connected to said power source, said computer means being constructed and arranged to control the power delivered by said power source to said heating resistor means and to continuously adjust the temperature of said power element during start up to a plurality of successive predetermined values which only depend on the initial temperature of said power element immediately before cranking and on time elapsed or number of revolutions of the engine after cranking of the engine, in accordance with a stored sequence.

2. A carburetor according to claim 1, wherein said computer means are constructed and arranged for continuously setting a set value of the idling speed of the engine and a set value of the temperature of the temperature sensor means and for regulating said temperature of the temperature sensor means for maintaining the set value of said idling speed when the engine is cold and idling and the set value of said temperature under all operating conditions of the engine.

3. A carburetor according to claim 2, wherein said set values are generated responsive to the start temperature of the temperature sensor means.

4. A carburetor according to claim 1, wherein said starting device has a hysteresis delaying closure of said air valve from its full opening position until the temperature of the temperature sensor means has decreased up to a predetermined value corresponding to a partial degree of opening.

5. A carburetor according to claim 1, further comprising additional means for delivering power to said heating resistor means after start up of the engine responsive to the speed of the engine exceeding a predetermined threshold.

6. A carburetor for an internal combustion engine, comprising:

(a) a body defining an intake duct, containing an operator operable throttle member, (b) a main fuel jet system which opens into said intake duct through an outlet located upstream of said throttle member, (c) an automatic starting device having an air valve located in said intake duct upstream of said outlet, said starting device including a temperature responsive power element operatively associated with said starting air valve and with abutment means limiting the extent of closure of said throttle valve, heating resistor means associated with said power element for controlling the temperature thereof and with a power source, temperature sensor means for providing a first signal representative of the temperature of said power element, sensor means for providing second signals representative of engine operating conditions, computer means having inputs connected to receive said first and second signals and an output connected to said power source, for controlling said power source responsive to said first and second signals, (d) and a manually adjustable idling circuit including a primary air supply, a fuel supply and an output for delivering a primary mixture having a high fuel/air ratio into the intake duct adjustable so as to give to the engine a fuel/air ratio during idling less than that which would be required in the absence of regulation and solenoid valve means controlled by computer means in response to a reduction in speed of the engine below a predetermined threshold for increasing the richness of the mixture supplied to the engine and avoiding stalling.

7. A carburetor according to claim 6 wherein said computer means is arranged to control said power source for speed regulation.

8. A carburetor according to claim 7, wherein said throttle member is devoid of fixed stop means and idling speed regulation after a normal operating temperature has been reached is achieved with modulation of the power applied by said power source with a substantial time constant.

9. A carburetor according to claim 6, wherein said computer means are constructed and arranged to control the power delivered by said power sources to said heating resistor means and to continuously adjust the temperature of said power element during start up to a plurality of successive predetermined values which only depend on the initial temperature of said power element immediately before cranking and on time elapsed or number of revolutions of the engine after cranking of the engine, in accordance with a stored sequence.

* * * * *